US007255026B1

(12) United States Patent
Lee

(10) Patent No.: US 7,255,026 B1
(45) Date of Patent: Aug. 14, 2007

(54) ONE-WAY MONKEY WRENCH

(76) Inventor: Yi Min Lee, No. 148, Chaofu Rd., Situn District, Taichung City 407 (TW)

( * ) Notice: Subject to any disclaimer, the term of this patent is extended or adjusted under 35 U.S.C. 154(b) by 0 days.

(21) Appl. No.: 11/367,169

(22) Filed: Mar. 2, 2006

(51) Int. Cl.
*B25B 13/12* (2006.01)

(52) U.S. Cl. ..... 81/179; 81/165

(58) Field of Classification Search ..... 81/179, 81/165, 170, 129
See application file for complete search history.

(56) References Cited

U.S. PATENT DOCUMENTS 2,630,037 A * 3/1953 McComb ..... 81/179
2,646,711 A * 7/1953 Yavner ..... 81/179
2,791,143 A * 5/1957 Rossi et al. ..... 81/165
2,937,551 A * 5/1960 Akers ..... 81/179
3,023,654 A * 3/1962 Stambaugh et al. ..... 81/179
3,280,669 A * 10/1966 Weaver ..... 81/179
3,858,467 A * 1/1975 Evans ..... 81/179
4,706,528 A * 11/1987 Inoue ..... 81/179
6,202,516 B1 * 3/2001 Kim ..... 81/179
7,077,035 B1 * 7/2006 Huang ..... 81/179

* cited by examiner

*Primary Examiner*—Hadi Shakeri
(74) *Attorney, Agent, or Firm*—Banger Shia

(57) ABSTRACT

A one-way monkey wrench includes a handle, a stationary jaw, a movable jaw, a worm and a one-way mechanism. The handle defines a groove, an opening in communication with a section of the groove and a tunnel. The stationary jaw is formed on the handle. The movable jaw is movably installed on the handle, and includes a rack movably positioned in the groove. The worm is rotationally positioned in the opening and engaged with the rack. The one-way includes a tongue movably positioned in the tunnel. The tongue includes an end, a sliding facet near the end and a pushing facet near the sliding facet. The sliding facet slides on an object when the one-way monkey wrench is rotated in a direction. The pushing facet pushes the object when the one-way monkey wrench is rotated in an opposite direction.

5 Claims, 6 Drawing Sheets

ONE-WAY MONKEY WRENCH

BACKGROUND OF INVENTION

1. Field of Invention

The present invention relates to a monkey wrench and, more particularly, to a one-way monkey wrench that is low in cost and easy in operation.

2. Related Prior Art

Fasteners such as threaded bolts and nuts are tightened and loosened by wrenches such as open-ended wrenches, box-ended wrenches, monkey wrenches one-way wrenches and socket wrenches.

A user can use a monkey wrench to drive fasteners of various sizes. In operation, the user engages the monkey wrench with a fastener, drives the fastener for an angle, and disengages the wrench from the fastener. The user may have to repeat this process for many times before the completion of the operation.

Alternatively, a user may use a one-way wrench to drive a fastener. In operation, the user engages a one-way wrench with a fastener, pivots the wrench in a direction so as to drive the fastener, and pivots the wrench in an opposite direction so as not to drive the fastener. The user does not have to repeat engagement and disengagement. However, the user has to use one-way wrenches of different sizes to drive fasteners of different sizes.

There have been one-way monkey wrenches such as those disclosed in Taiwanese Patent nos. 395311, 453253 and 566273. Two major problems have been encountered in the manufacturing and use of these one-way monkey wrenches. Firstly, their manufacturing is difficult since many parts are made and assembled into sophisticated structures. Secondly, their operation is not precise since they often slide on fasteners.

The present invention is therefore intended to obviate or at least alleviate the problems encountered in prior art.

SUMMARY OF INVENTION

It is an objective of the present invention to provide a one-way monkey wrench that is low in cost.

It is another objective of the present invention to provide a one-way monkey wrench that is easy in operation.

According to the present invention, a one-way monkey wrench includes a handle, a stationary jaw, a movable jaw, a worm and a one-way mechanism. The handle defines a groove, an opening in communication with a section of the groove and a tunnel. The stationary jaw is formed on the handle. The movable jaw is movably installed on the handle, and includes a rack movably positioned in the groove. The worm is rotationally positioned in the opening and engaged with the rack. The one-way includes a tongue movably positioned in the tunnel. The tongue includes an end, a sliding facet near the end and a pushing facet near the sliding facet. The sliding facet slides on an object when the one-way monkey wrench is rotated in a direction. The pushing facet pushes the object when the one-way monkey wrench is rotated in an opposite direction.

Other objectives, advantages and features of the present invention will become apparent from the following description referring to the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
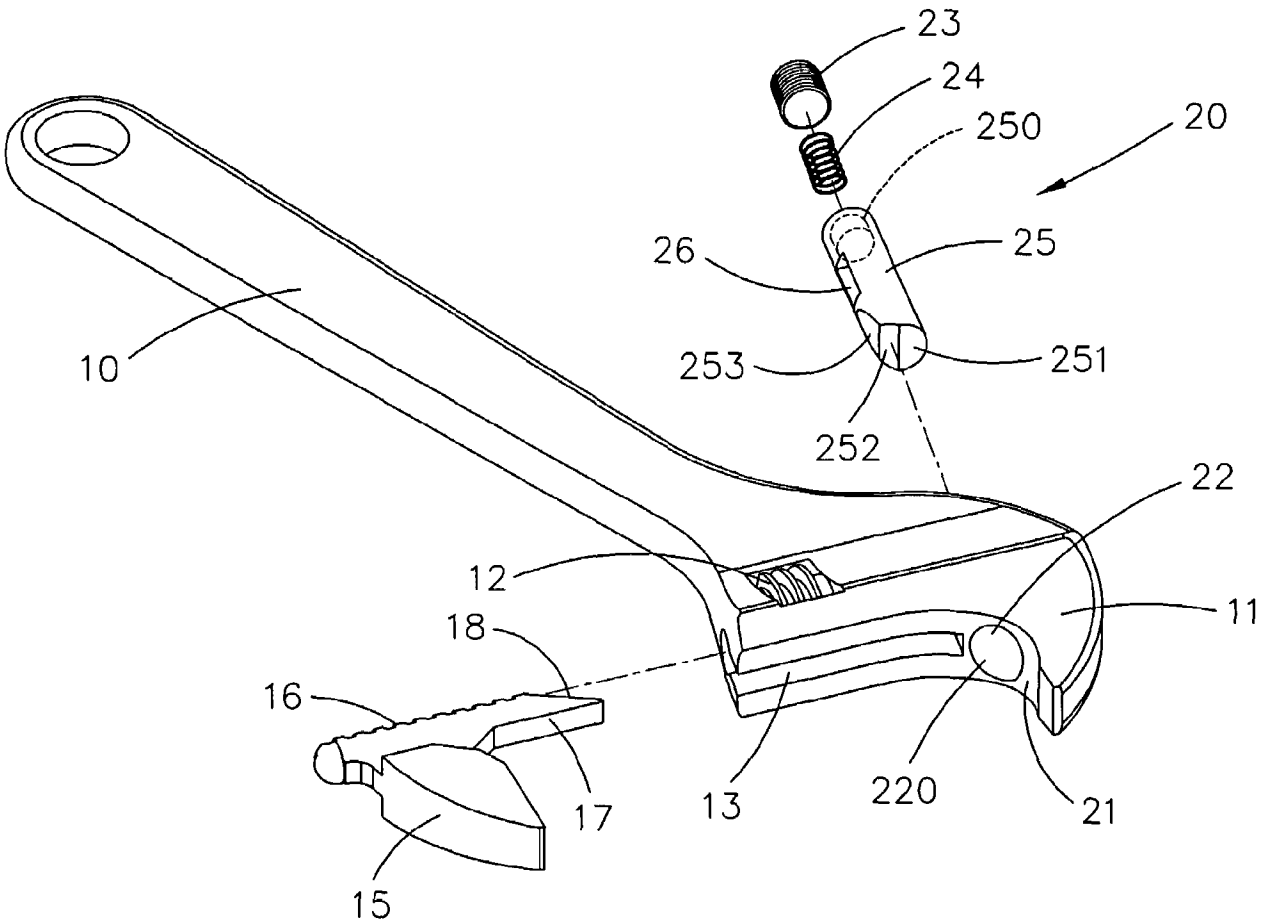
FIG. 1 is an exploded view of a one-way monkey wrench according to the preferred embodiment of the present invention.
Figure 2:
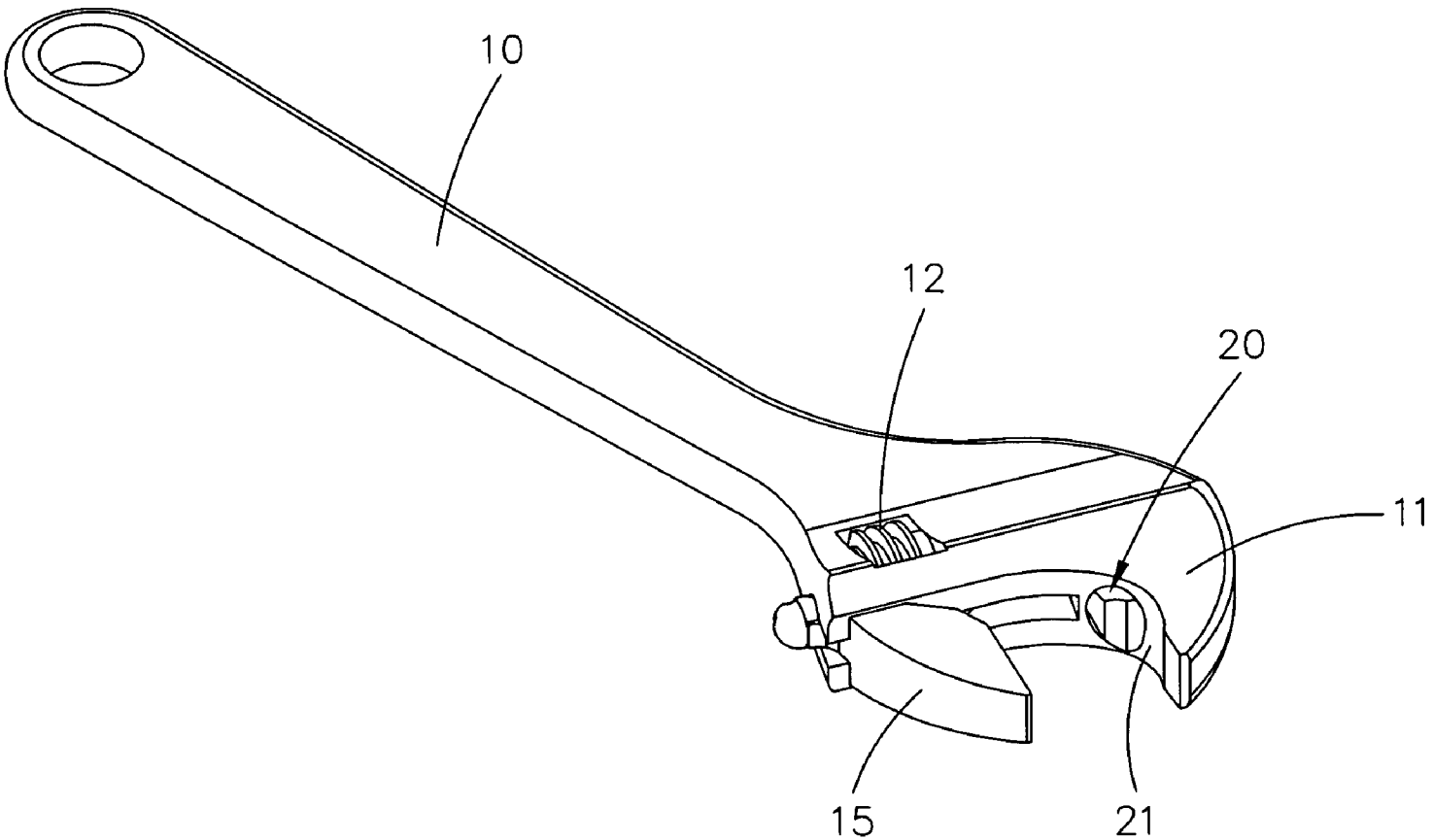
FIG. 2 is a perspective view of the one-way monkey wrench shown in FIG. 1.
Figure 3:
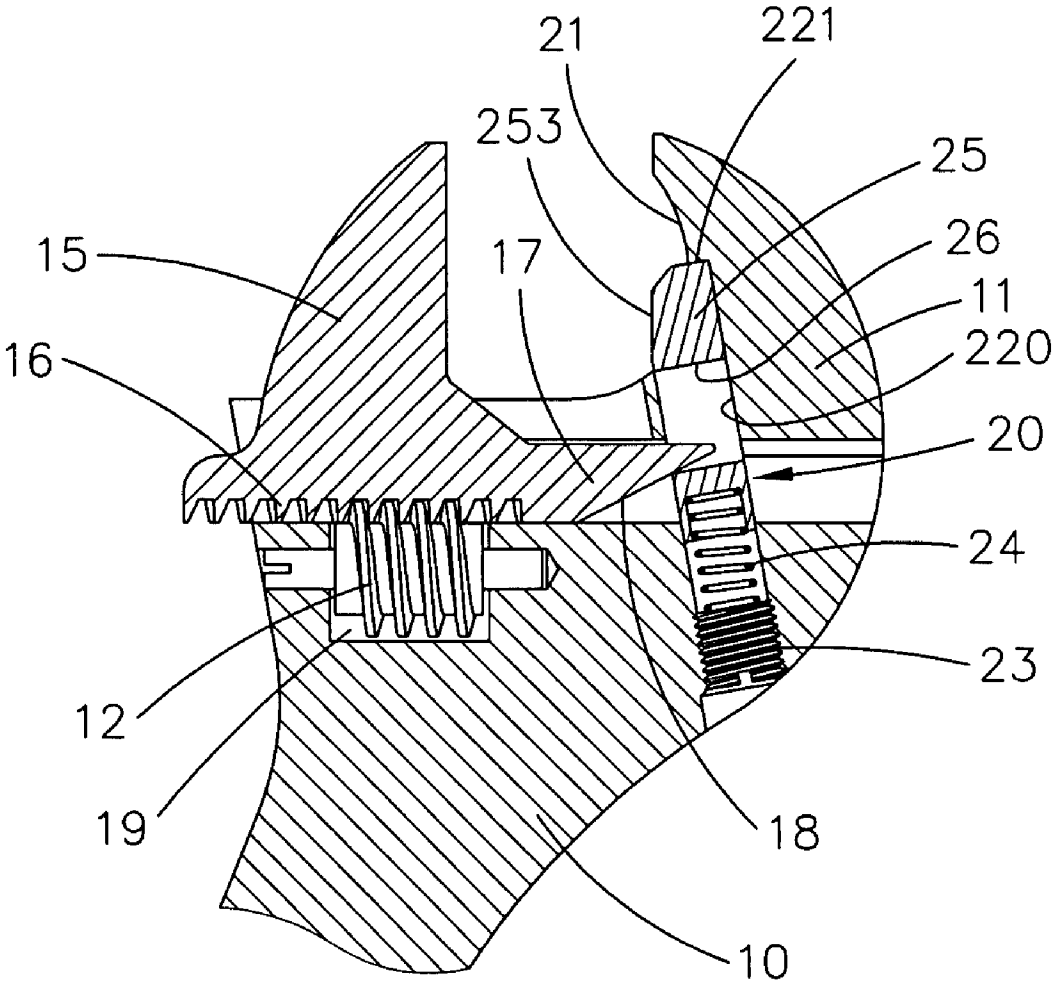
FIG. 3 is an enlarged, partial, cross-sectional view of the one-way monkey wrench shown in FIG. 2.

Referring to FIGS. 1 through 3, there is shown a one-way monkey wrench according to the preferred embodiment of the present invention. The one-way wrench includes a handle 10, a stationary jaw 11 formed on the handle 10, a movable jaw 15 movably installed on the handle 10 and a one-way mechanism 20 installed on the stationary jaw 11.

The handle 10 defines a groove 13, an opening 19 in communication with a section of the groove 13 and a tunnel 22 in communication with an end of the groove 13. The tunnel 22 includes an end 220. As clearly shown in FIG. 3, a restraint 221 is formed on the wall of the tunnel 22 near the end 220. A thread 222 is formed on the wall of the tunnel 22 near an opposite end.

A worm 12 is rotationally positioned in the opening 19.

The movable jaw 15 is formed with a rack 16 movably positioned in the groove 13. The rack 16 is engaged with the worm 12 so that a user can move the movable jaw 15 relative to the stationary jaw 11 by rotating the worm 20. The rack 16 is formed with a wedge 17 that includes an inclined edge 18.

The one-way mechanism 20 includes a tongue 25 movably positioned in the tunnel 22 and restrained by the restraint 221, an elastic element 24 positioned in the tunnel 22 and a threaded bolt 23 engaged with the thread 222 so as to retain the elastic element 24 and the tongue 25 within the tunnel 22.

The tongue 25 includes an end 251, a sliding facet 252 near the end 251 and a pushing facet 253 near the sliding facet 252. The tongue 25 defines a recess 250 at an opposite end and a slot 26 between the ends. The end 251 of the tongue 25 is restrained by the restraint 221. The recess 250 receives the elastic element 24. The slot 26 receives the wedge 17.

Figure 4:
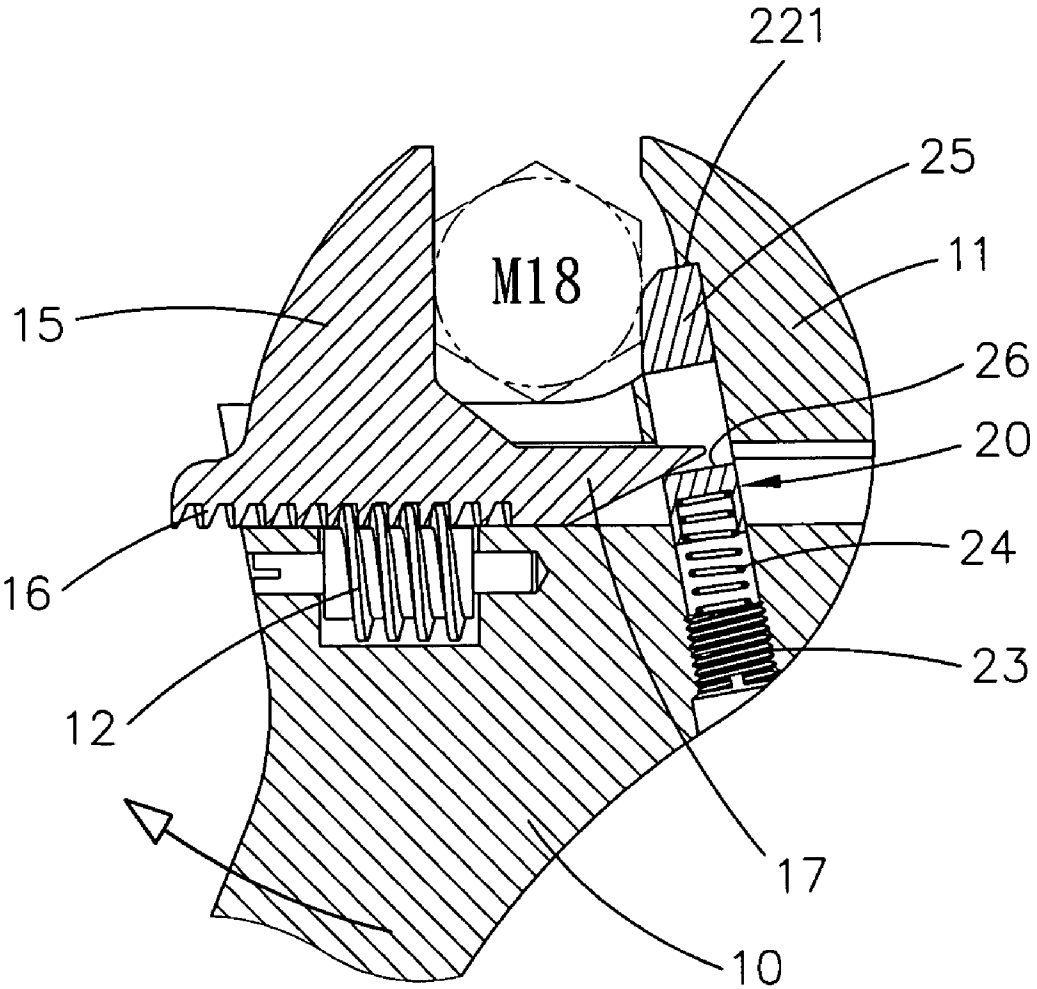
FIG. 4 is a cross-sectional view of the one-way monkey wrench shown in FIG. 3 pivoted in a direction so as to drive a fastener.

Referring to FIG. 4, the pushing facet 253 of the tongue 25 is in contact with a first side of a fastener while the movable jaw 15 is in contact with an opposite second side of the fastener. The first side is between an upstream corner and a downstream corner regarding the direction of the rotation of the one-way monkey wrench. The contact point between the pushing facet 253 of the tongue 25 and the first side of the fastener is closer to the downstream corner than the upstream corner. The one-way monkey wrench is pivoted in a direction so that the pushing facet 253 of the tongue 25 is in tighter contact with the first side of the fastener, and so is the movable jaw 15. Hence, the pivoting of the one-way wrench in this direction causes the rotation of the fastener in the same direction.

Figure 5:
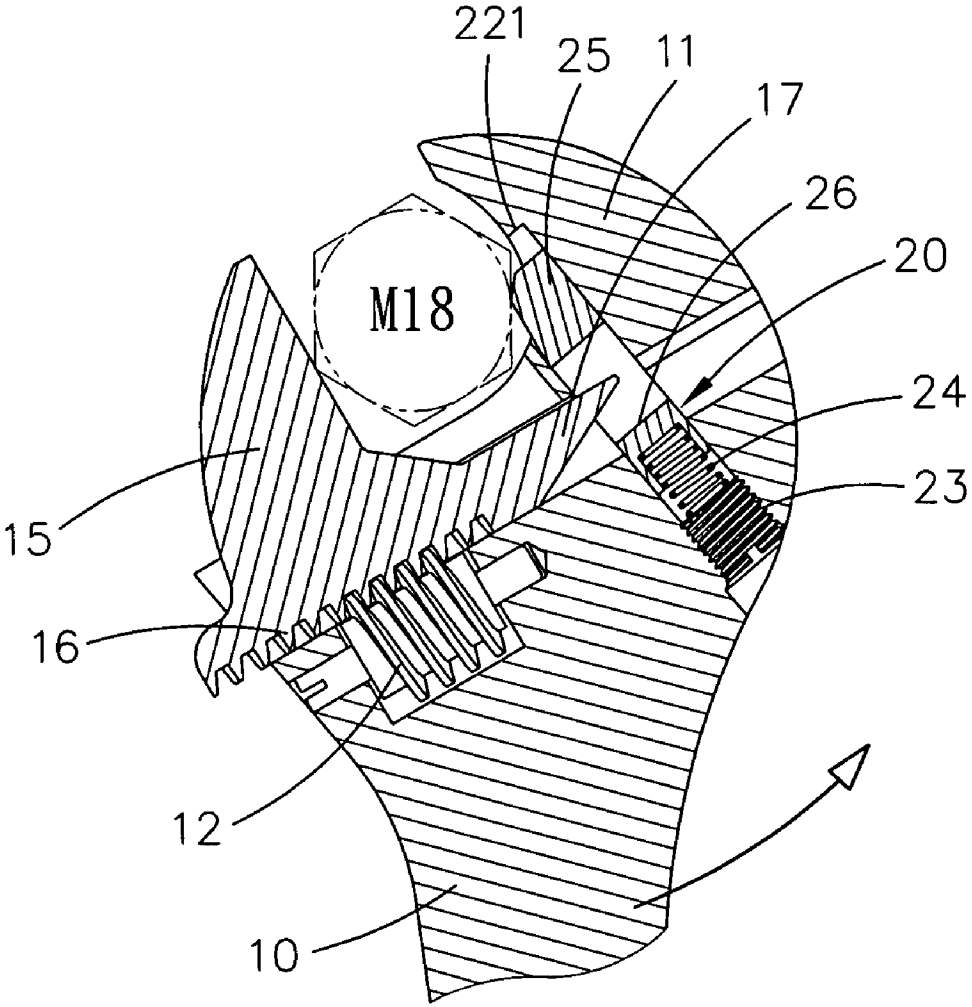
FIG. 5 is a cross-sectional view of the one-way monkey wrench shown in FIG. 4 pivoted in an opposite direction so as not to drive the fastener.

Referring to FIG. 5, the one-way monkey wrench is pivoted in an opposite direction so that the sliding facet 252 contacts the fastener. The pivoting of the one-way monkey wrench causes the withdrawing of the tongue 25 that the elastic element 24 allows so that the pivoting of the one-way wrench does not cause the rotation of the fastener.

Figure 6:
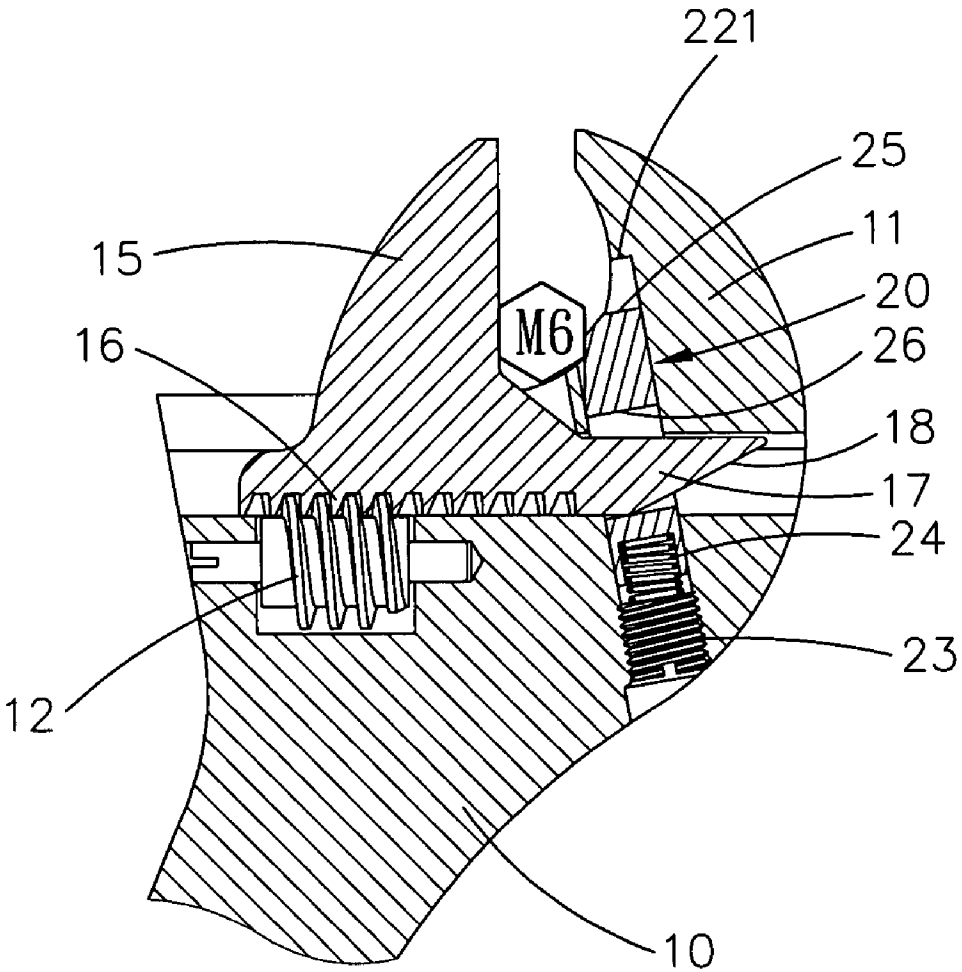
FIG. 6 is a cross-sectional view of the one-way monkey wrench shown in FIG. 3 pivoted in a direction so as to drive a small fastener.

Referring to FIG. 6, the one-way monkey wrench is engaged with a small fastener much smaller than that is shown in FIGS. 4 and 5. The movable jaw 15 is moved toward the stationary jaw 11 as well as the tongue 25. The wedge 17 causes the tongue 25 to withdraw so that the pushing facet 253 comes into contact with the small fastener.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A one-way monkey wrench comprising:

a handle defining a groove, an opening in communication with a section of the groove and a tunnel;

a stationary jaw formed on the handle;

a movable jaw movably installed on the handle, the movable jaw comprising a rack movably positioned in the groove;

a worm rotationally positioned in the opening and engaged with the rack; and a one-way mechanism comprising a tongue movably positioned in the tunnel, the tongue comprising a sliding facet and a pushing facet near the sliding facet, the sliding facet sliding on an object when the one-way monkey wrench is rotated in a direction, the pushing facet pushing the object when the one-way monkey wrench is rotated in an opposite direction, wherein the tongue defines a slot, wherein the rack comprises a wedge movably positioned in the slot so that the tongue is withdrawn by the wedge when the movable jaw is moved toward the stationary jaw.

2. The one-way monkey wrench according to claim 1 wherein the handle comprises, on the wall of the tunnel near an end, a restraint for contact with the end of the tongue.

3. The one-way monkey wrench according to claim 2 wherein the one-way mechanism comprises a threaded bolt, wherein the handle comprises, on the wall of the tunnel near an opposite end, a thread engaged with the threaded bolt so that the tongue is confined between the restraint and the threaded bolt.

4. The one-way monkey wrench according to claim 3 wherein the one-way mechanism comprises an elastic element compressed between the tongue and the threaded bolt.

5. The one-way monkey wrench according to claim 4 wherein the tongue defines, at an opposite end, a recess for receiving the elastic element.

* * * * *